United States Patent [19]

Biagini

[11] Patent Number: 4,872,430

[45] Date of Patent: Oct. 10, 1989

[54] VALVE SYSTEM FOR RECIPROCATING ENGINES

[75] Inventor: Livio Biagini, Bologna, Italy

[73] Assignee: B-ART S.r.l., Bologna, Italy

[21] Appl. No.: 174,716

[22] Filed: Mar. 29, 1988

[30] Foreign Application Priority Data

Apr. 6, 1987 [IT] Italy ..... 47813 A/87

[51] Int. Cl.[4] ..... F01L 3/00

[52] U.S. Cl. ..... 123/188 A; 123/188 AA; 123/188 B

[58] Field of Search ..... 123/188 A, 188 AA, 188 R, 123/188 GC, 188 B

[56] References Cited

U.S. PATENT DOCUMENTS 2,035,165 3/1936 Jardine ..... 123/188 S 4,475,494 10/1984 Huther ..... 123/188 AA

FOREIGN PATENT DOCUMENTS 351798 2/1905 France ..... 123/188 A

*Primary Examiner*—E. Rollins Cross

*Attorney, Agent, or Firm*—Robert E. Burns; Emmanuel J. Lobato

[57] ABSTRACT

This invention relates to a valve system for reciprocating engines, said system comprising at least two cylindrical guides obtained in the cylinder head; a valve for each guide, said valve being slidable inside the guide itself, without never projecting into the cylinder; ducts or channels obtained in said cylinder head which make one of said guides and hence the cylinder itself to communicate, following to the motion of the corresponding valve, with the induction or the exhaust system; and sealing means between each one of said valves and the corresponding guide; said valves being designed so as to open in their motion the passage of the corresponding channel or duct towards the outside of the cylinder.

21 Claims, 5 Drawing Sheets

VALVE SYSTEM FOR RECIPROCATING ENGINES

DISCLOSURE OF THE INVENTION

The present invention relates to a valve system for reciprocating engines. More exactly, the present invention relates to a system of the type mentioned above in which the valves, which are of a substantially cylindrical shape, slide inside guides obtained in the head of the cylinder towards its outside part so as to allow engine performances to be obtained which are much higher than those obtained with conventional valve systems.

As is well known, the operation of a four-stroke engine is divided into four phases, which take two full revolutions of the driving shaft, and more exactly the phases of induction or intake, compression, explosion, combustion, expansion, exhaust.

Such four phases occur within the space limited by the cylinder walls, by the piston head (which piston moves in a reciprocating way from the top dead center to the bottom dead center), and by the fixed head on the cylinder crown.

The characteristics parameters of each engine are: the bore, the stroke, and the compression ratio.

The four-stroke engine is also characterized in addition by:

- the number and the diameter of the valves placed on the cylinder head,
- the valve control type,
- the shape of the combustion chamber (when the piston is at the top dead center).

The operation parameters of the engine are:

- the average effective pressure, which substantially depends by the volumetric and thermodynamic yield and by the specified above geometrical characteristics of the engine,
- the working number of revolutions, from which number the power and the torque of the engine itself are determined.

The strokes of intake and exhaust occur through the valve system. Such valves are defined as the intake and exhaust valves, according to whether they start operating in the intake stroke or in the exhaust stroke, and they put the cylinder inside in communication respectively with the intake and the exhaust system.

The valve performs its "opening" motion towards the inside of the cylinder through a kinematic motion so designed as to overcome properly the inertia forces which would keep the valve in the preceding position, as well as the other forces (the pressure in the cylinder, the forces of the elastic system), which act on the valves themselves.

Since the times of the first constructions of reciprocating engines, the motion of the valve to put the inside of the cylinder in communication with the inlet or the exhaust system, has been realized mainly through its translation towards the inside of the cylinder.

Such type of motion has been chosen mainly for privileging the need for a perfect tightness or "sealing" of the cylinder with respect to any other parameter.

Accordingly, when the valve is closed, the "sealing" of the cylinder with respect to the inlet system or to the exhaust system occurs through the contact between the rim of the valve itself and a corresponding part on the head, having a diameter lower than the maximum outside diameter of the valve itself.

Various kinds of valves have been realized which are fundamentally different both as regards the type of motion towards the inside of the cylinder, and as regards the shape of the sealing ledge between the valve and the cylinder head. More particularly, poppet valves, valves hinged laterally and plate-head valves having a cylindrical sealing surface are dealt with here.

All such valve types and the relative sealing principles of the cylinder are employed at the present time in reciprocating engines, Otto cycle and Diesel cycle, as well as in types of Wankel engines and of two-stroke engines. The technological and constructive perfection reached at the present time is such that these particular engines normally produced are all long lasting.

When considering the field of highly compressed engines (such as Diesel engines or racing engines), the need for reducing the sizes of the explosion chamber to obtain high values of the compression ratio, counteracts the requirement of having the valves open at the top dead center of the piston in order to increase the crossing and inlet diagrams, in order to increase the volume yield at the other r.p.m.'s and, at the same time, to have a small explosion chamber which decreases the ignition lag of the air-fuel mixture.

From such considerations the existence can be inferred of an upper limit to the maximum number of revolutions can be obtained from a given engine, because of the impossibility of causing the necessary weight of mixture to flow into the cylinder, when the maximum number of revolutions of the engine becomes higher than that which is suitable to allow the intake valve to keep open for the time sufficient for a good filling of the cylinder itself.

Taking into account the considerations above, and aiming at solving the problems outlined above so as to allow the realization of reciprocating engines having high compression ratios and at the same time an optimal crossing and intake diagram, and a concentrated explosion chamber, the Applicant suggests a basic technical solution for the realization of a valve system for reciprocating engines in which the valves slide inside guides obtained in the head, and the "sealing38 is obtained through circular peripheral contact between the cylindrical wall of the valve and the inner wall of said guides, so that the valves, to determine the intake or the exhaust, slide towards the outside of the cylinder and not towards the inside of the same as occurs usually.

Accordingly, it is a specific object of the present invention a valve system for reciprocating engines comprising at least two cylindrical guides obtained in the cylinder head; a valve for each guide, said valve being slidable inside the guide itself, without projecting into the cylinder; channels or ducts obtained in said cylinder head which put one of said guides and hence the cylinder itself in communication with the intake or the exhaust system following to the motion of the corresponding valve; and sealing means between each one of said valves and the corresponding guide; said valves being provided with a motion that opens the passage of the corresponding channel or duct which is directed towards the outside of the cylinder.

In the realization of the valve system according to the present invention, said valves can be made up of a body consisting of different parts connected to each other, or of a single body, said parts being of circular or oval cross section or anyway of a cross section which is suitable to slide inside the guide.

Again according to the present invention, the guides obtained in the cylinder head can be of constant cross section or they can have a projecting part of diameter or sizes lower than those of the guide itself, at the point corresponding to the combustion chamber.

Further according to the present invention said channels or ducts face the guide with openings in the cylinder head at such a distance from the combustion chamber as to allow the sealing between valve and guide to be realized, so as to isolate the combustion chamber, and to allow the cylinder to be put in communication, during the opening of the valve itself, with the intake or exhaust system.

Said guides can be obtained directly in the cylinder head or they can be assembled, as realized with the same material or with a different material, within a housing obtained in the head itself.

According to a preferred embodiment of the valve system of the present invention, the valves consist of a valve head that faces the combustion chamber, of a cylindrical part which is important for realizing the sealing between the inside of the engine and the outside of the system, of a stem, of a guide member, all being of diameters equal to or different from the preceding ones, and of a member connecting the valve to the system for driving the valves themselves.

The sealing between the valve and the guide can be realized also through elastic rings of a metallic material or with rings of a composite material.

Said rings can have rectangular sections or L-shaped or C-shaped cross sections, and they can be arranged on said cylindrical part of the valve or directly on the guide or on the terminal projecting part of the latter.

The present invention will be disclosed in the following just for illustrative and not for limitative purposes, with particular reference to the enclosed drawings wherein.

Figure 1:
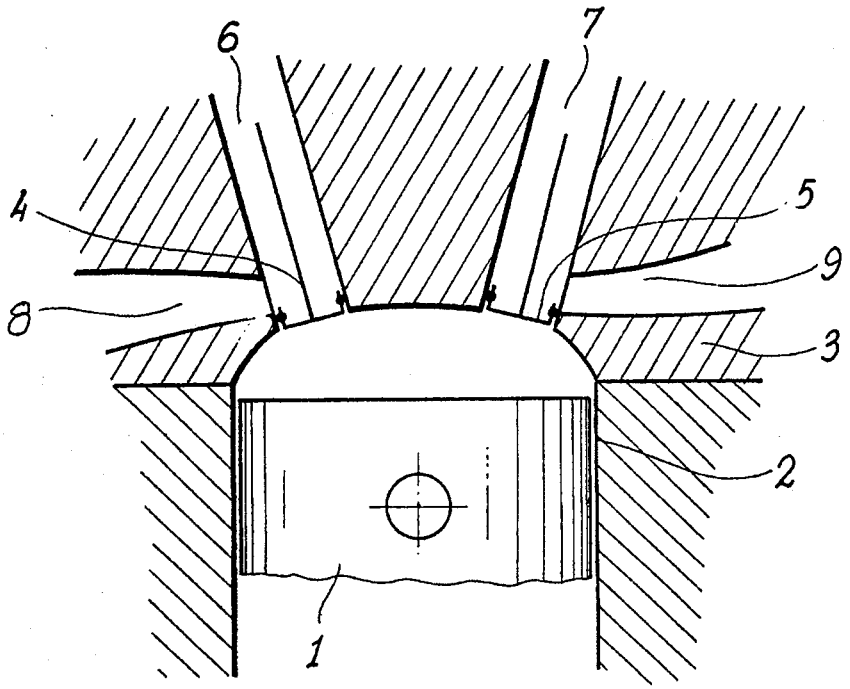
FIG. 1 is a cross sectional schematic view of the valve system according to the present invention.

With reference now to FIG. 1, it can be observed that the piston 1 slides inside the cylinder 2 which is closed at the top by the head 3.

The two valves, i.e., the intake valve 4 and the exhaust valve 5, slide within said head 3 respectively inside the two guides 6 and 7 obtained in the head 3 itself.

Again in said cylinder head 3 two channels 8 and 9 are obtained which put the inside of the cylinder 1 in communication with the outside system. The two channels 8 and 9 are obtained along the guides 6 and 7 so as to put the inside of the cylinder 2 in communication with the intake or the exhaust system according to the operating stroke of engine.

Figure 2:
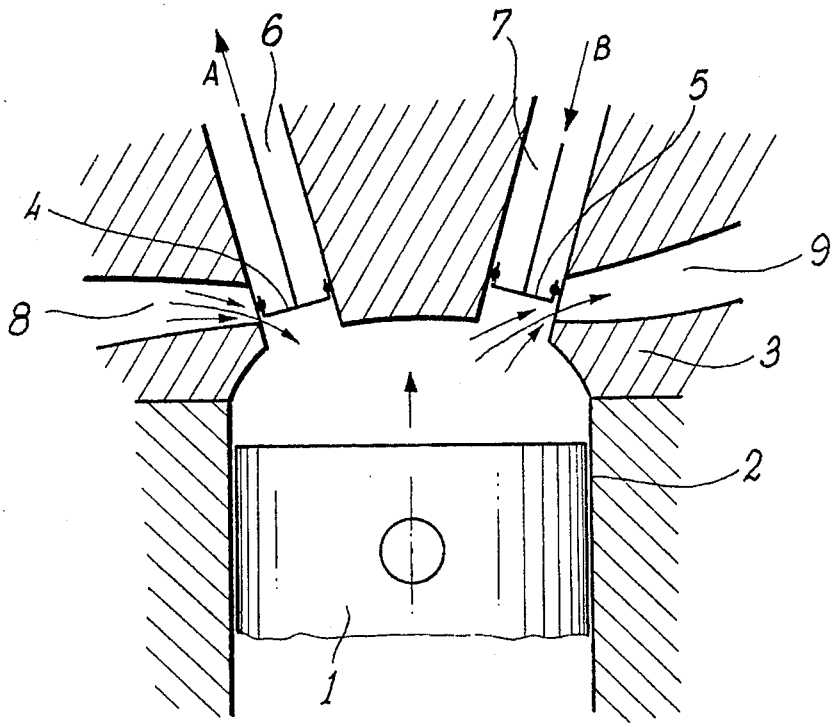
FIG. 2 is a cross section schematic view of the valve system of FIG. 1 with the piston at the top dead center.

In the working stroke shown in FIG. 2, in which the piston 1 is close to the top dead center, the crossing occurs of the opening of valves 4 and 5 so that the intake valve 4 is in the opening stroke (the direction of arrow A), and the exhaust valve 5 is on the point of closing (direction of the arrow B).

In that situation, the crossing of the opening of the intake valve 4 and of the exhaust valve 5 is necessary to overcome the inertia of the inlet fresh gases and to allow the intake valve 4 to be already enough open during the intake stroke, with regular "breathing" of the engine.

Figure 3:
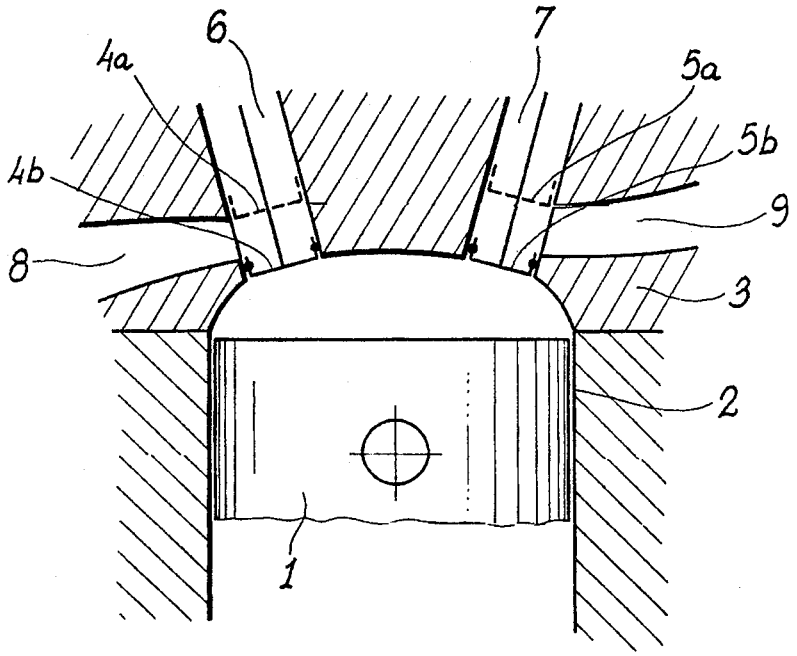
FIG. 3 is a cross section schematic view of the valve system according to the present invention, the positions of opening and closing of the intake and exhaust valves being pointed out.

The two positions of the valves 4 and 5, pointed out respectively by 4*a* and 4*b*, 5*a* and 5*b* in FIG. 3 put into more evidence the fact that the motion of said valves occurs towards the outside of the cylinder 2 within the cylinder head 3, and not towards the inside of said cylinder.

It is evident that, by means of the valve system according to the present invention it is possible to open the valve when the piston 1 reaches the top dead center almost touching the cylinder head 3 in case of very high compression ratios (short-stroke Diesel engines, racing engines).

Figure 4:
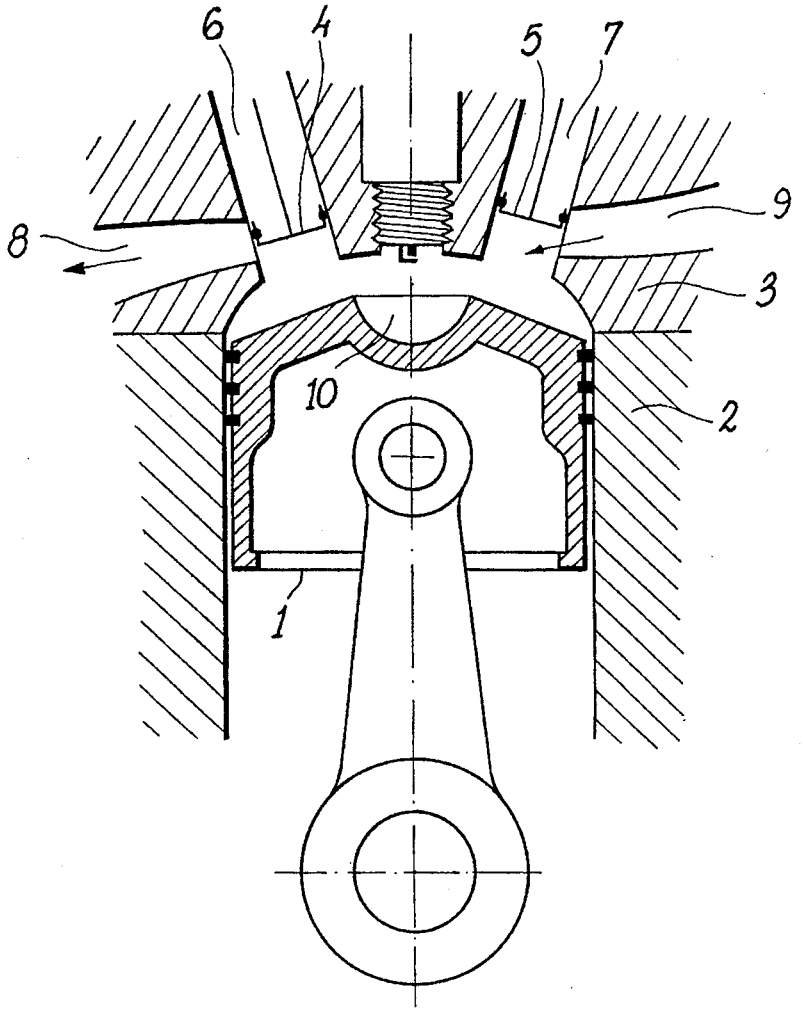
FIG. 4 is a cross section schematic view of the valve system according to the present invention, a particular embodiment of the combustion chamber being shown.

Indeed, looking at the FIG. 4, it can be observed that the intake valves 4 and the exhaust valves 5 can be "opened" at will when the piston 1 is at the top dead center (TDC) with no danger of interference.

Moreover, another very important advantage that can be obtained consists in the fact that the explosion chamber 10, which can be obtained in the crown of the piston 1, can be of the most reasonable shape possible, to obtain a thermodynamic yield of higher value.

The problem of "sealing" the inside part of the cylinder 2 to isolate the same from the inlet and exhaust system is solved with suitable compression rings of the type employed for the piston (they are shown schematically in the figure).

Moreover, the "opening" motion of the valve 4, which valve could rightly be called "a diving valve" as it dives towards the cylinder 2 so as to close the communication of the same with the outside system, is made easier in the exhaust stroke because of the residual pressure within the cylinder 2 that is caused by the expansion of gases, so that the need for a kinematic device having strong return springs is decreased, in case of spring control. In addition, as there is no sealing "ledge" between the valve and the housing or seat, the need of the so called "valve slack" is eliminated, whereas the lack of the same would cause in traditional engines the rapid failure of the valve itself.

In addition a valve system is obtained in such a way which is cheaper to build. In the case of valve positive control, i.e. in case of mechanical control of valve opening and closing, the advantage is obtained that the inside pressure within the cylinder causes the opening of the valve, so that such positive control is easier to design and build.

Valves 4 and 5 can be made up of a material cheaper (and lighter) than that of valves employed at present, as they are not subjected to impacts on their rims, because they perform just a screening function.

Figure 5:
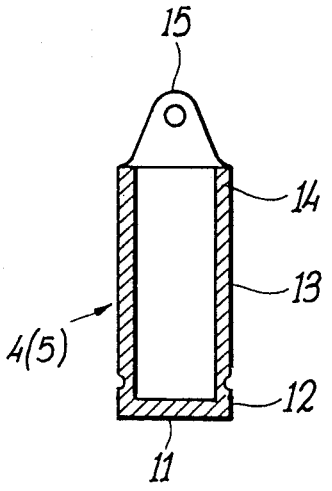
FIG. 5 is a cross section schematic view of a first kind of embodiment of a valve of the system according to the present invention.
Figure 6:
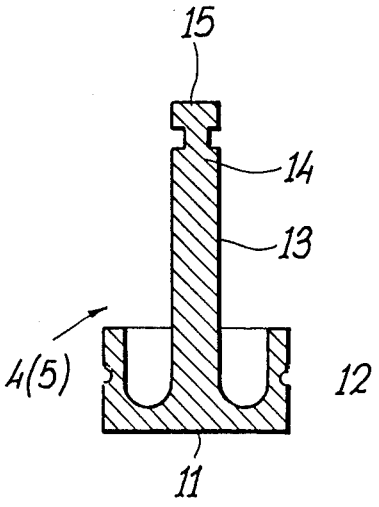
FIG. 6 is a cross section schematic view of a second kind of embodiment of a valve of the system according to the present invention.
Figure 7:
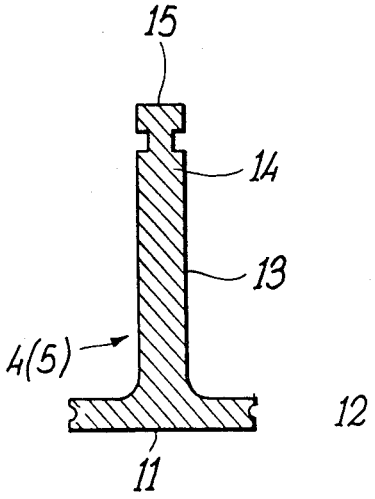
FIG. 7 is a cross section schematic view of a third kind of embodiment of a valve of the system according to the present invention.

With reference now to FIGS. 5, 6 and 7, it can be observed that the valve 4 (or 5) can be of various shapes.

In each one of the specific embodiments shown anyway a valve head 11 is provided that, when the valve is closed, faces the explosion and combustion chamber 10.

Moreover, there are a cylindrical portion 12 of such a height as to carry possibly the tightness or "sealing" members, a stem 13 connecting the valve head 11 to a guiding member 14, which stem can be of a diameter different from that of the head 11 (FIGS. 6 and 7) whose object is that of keeping the valve 4 (or the valve 5) in the trajectory during motion.

Finally, a connecting portion 15 is provided between said guiding member 14 and the driving system (not shown) of the valve 4 or 5.

The tightness or "sealing members 16 are of a known type, and they can be arranged also in the terminal portion of the guide 6 (or 7) or on the rim of the guide 6 (or 7) itself at the point corresponding to the combustion chamber 10, besides to be arranged on the portion 12 of the valve 4 (or of the valve 5).

The present invention has been disclosed according to some preferred embodiments of the same but it is to be understood that modifications and/or changes can be introduced by those who are skilled in the art without departing from the spirit and scope of the invention for which a prority right is claimed.

I claim:

1. A valve system for reciprocating engines, characterized in that it comprises at least two cylindrical guides obtained in the cylinder head; a valve for each guide, which is slidable inside the guide itself without projecting into the inside part of the cylinder; channels or ducts obtained in said cylinder head which put one of said guides and the cylinder itself in communication with the intake or exhaust system following to the motion of the corresponding valve; and sealing means between each one of said valves and the corresponding guide; said valves being provided with a motion that opens the passage of the corresponding channel towards the outside of the cylinder.

2. A valve system according to claim 1, characterized in that each one of said valves comprises a cylindrical part on which said sealing means is located and a part connecting said cylindrical part with a valve driving system.

3. A valve system according to claim 1, characterized in that each one of said valves is an integral body.

4. A valve system according to claims 2 or 3, characterized in that said valves are of circular cross section.

5. A valve system according to claims 2 or 3, characterized in that said valves are of oval cross section.

6. A valve system according to claim 1 characterized in that said cylindrical guides obtained in the cylinder head are of constant cross section.

7. A valve system according to claim 1, characterized in that said cylindrical guides obtained in the cylinder head have a projecting part at the point corresponding to the combustion chamber, said projecting part being of sizes or diameter lower than those of the guide itself.

8. A valve system according to claim 1, characterized in that channel or ducts are obtained within the cylinder head, said channels having openings on the valve guide at such a distance from the combustion chamber as to allow a perfect sealing to be obtained between the valves, the guide and the combustion chamber itself, and such as to allow the combustion chamber to be put in communication with the intake or the exhaust system during the opening of the valve itself.

9. A valve system according to claim 1, characterized in that said guides are obtained directly within the cylinder head.

10. A valve system according to claim 1, characterized in that said guides are introduced into a housing obtained in the cylinder head itself.

11. A valve system according to claim 10, characterized in that said guides are realized with the same material as that of the cylinder head.

12. A valve system according to claim 10, characterized in that said guides are realized with a material different from that of the cylinder head.

13. A valve system according to claim 1, characterized in that each one of said valves consists of a valve head facing the combustion chamber; of a cylindrical part; of a stem; of a guiding member which is of a diameter equal to or different from the diameter of the preceding members; and a member which connects the valve itself with the system for driving the valves.

14. A valve system according to claim 1, characterized in that said sealing means are made up of elastic rings consisting of a metallic material.

15. A valve system according to claim 1, characterized in that said sealing means are made up of rings consisting of a composite material.

16. A valve system according to claims 14 or 15, characterized in that said rings are of rectangular cross section.

17. A valve system according to claims 14 or 15, characterized in that said rings have L-shaped cross sections.

18. A valve system according to claims 14 or 15, characterized in that said rings have C-shaped cross sections.

19. A valve system according to claims 13 and 14 or 15, characterized in that said rings are arranged on said cylindrical part of the valve.

20. A valve system according to claims 6 and 14 or 15, characterized in that said rings are arranged directly on the guide.

21. A valve system according to claims 7 and 14 or 15, characterized in that said rings are arranged on the terminal projecting part of the guide.

* * * * *